US008417157B2

(12) United States Patent
Saito et al.

(10) Patent No.: US 8,417,157 B2
(45) Date of Patent: Apr. 9, 2013

(54) DEVELOPER STORAGE CONTAINER HAVING A TURN STOP PART

(75) Inventors: Kazuhiro Saito, Saitama (JP); Iwao Kuriki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 306 days.

(21) Appl. No.: 12/813,054

(22) Filed: Jun. 10, 2010

(65) Prior Publication Data

US 2010/0316414 A1 Dec. 16, 2010

(30) Foreign Application Priority Data

Jun. 11, 2009 (JP) ..... 2009-140298

(51) Int. Cl.
*G03G 15/08* (2006.01)

(52) U.S. Cl. ..... 399/258

(58) Field of Classification Search ..... 399/258, 399/260, 262, 110
See application file for complete search history.

(56) References Cited

U.S. PATENT DOCUMENTS

| | | | |
|---|---|---|---|
| 6,023,594 A | 2/2000 | Okiyama et al. | |
| 2005/0196180 A1 | 9/2005 | Harumoto | |
| 2011/0064481 A1* | 3/2011 | Ishiguro et al. | 399/263 |

FOREIGN PATENT DOCUMENTS

| | | | |
|---|---|---|---|
| EP | 1681603 A2 | | 7/2006 |
| JP | 08-171330 A | | 7/1996 |
| JP | 2000-231252 A | | 8/2000 |
| JP | 2001109349 A | * | 4/2001 |
| JP | 2001-242692 A | | 9/2001 |
| JP | 2001-281948 A | | 10/2001 |
| JP | 2003-295593 A | | 10/2003 |
| JP | 2005-250375 A | | 9/2005 |

OTHER PUBLICATIONS

Japanese Office Action dated Jul. 13, 2009 in counterpart Japanese Application No. 2009-140298.
Communication dated Jul. 3, 2012 from the European Patent Office in counterpart European application No. 10165745.0.

* cited by examiner

*Primary Examiner* — Quana M Grainger
(74) *Attorney, Agent, or Firm* — Sughrue Mion, PLLC

(57) ABSTRACT

A developer storage container includes a container main body, an outflow port, an open/closed member and a turn stop part. The outflow port from which a developer flows out is formed in the container main body storing the developer. The open/closed member is supported to the container main body and, moves relative to the container main body based on a rotation of the container main body. The open/closed member opens and closes the outflow port. The turn stop part is formed on a wall face of the container main body, and has a circular arc shape being concentric with a rotation direction of the container main body. The turn stop part engages with a convex part which is provided in the attachment section and is formed at a different position in response to the image forming apparatus body.

20 Claims, 17 Drawing Sheets

DEVELOPER STORAGE CONTAINER HAVING A TURN STOP PART

CROSS-REFERENCE TO RELATED APPLICATIONS

This application is based on and claims priority under 35 USC 119 from Japanese Patent Application No. 2009-140298 filed on Jun. 11, 2009.

BACKGROUND

1. Technical Field

This invention relates to a developer storage container and an image forming apparatus.

2. Related Art

In image forming apparatus of a copier, a printer, etc., arts relating to a developer storage container, there is a toner cartridge to be supplied with a developer consumed with image forming processing.

SUMMARY

According to an aspect of the invention, a developer storage container includes a container main body, an outflow port, an open/closed member and a turn stop part. A developer is stored in the container main body. The container main body is configured to be attached to and detached from an attachment section provided in an image forming apparatus main body. And, the container main body is configured to at least rotate in a state that the container main body is inserted into the attachment section, to a detachable position at which the container main body can be detached from the attachment section and an undetachable position at which the container main body cannot be detached from the attachment section. The outflow port is formed in the container main body and from which the developer flows out. The open/closed member moves relatively to the outflow port based on a rotation of the container main body. The open/closed member is supported so as to move to an opened position at which the outflow port is opened and a closed position at which the outflow port is closed. The open/closed member moves to the closed position when the container main body moves to the detachable position. The open/closed member moves to the opened position when the container main body moves to the undetachable position. And, the turn stop part is formed on a wall face of the container main body, the wall face being provided on a downstream side in a insertion direction in which the container main body is inserted into the attachment section. The turn stop part is dented to an upstream side in the insertion direction and has a circular arc shape being concentric with a rotation direction of the container main body. The turn stop part is configured to engage with a convex part which (i) projects to the upstream side in the insertion direction, (ii) is provided in the attachment section and (iii) is formed at a different position in response to the image forming apparatus body. The turn stop part has at least a central angle corresponding to a rotation angle at which the container main body rotates to the detachable position and the undetachable position. And, the turn stop part comes in contact with the convex part when the open/closed member moves to the opened position.

BRIEF DESCRIPTION OF THE DRAWINGS

Exemplary embodiment(s) of the present invention will be described in detail based on the following figures, wherein.

DETAILED DESCRIPTION

Figure 1:
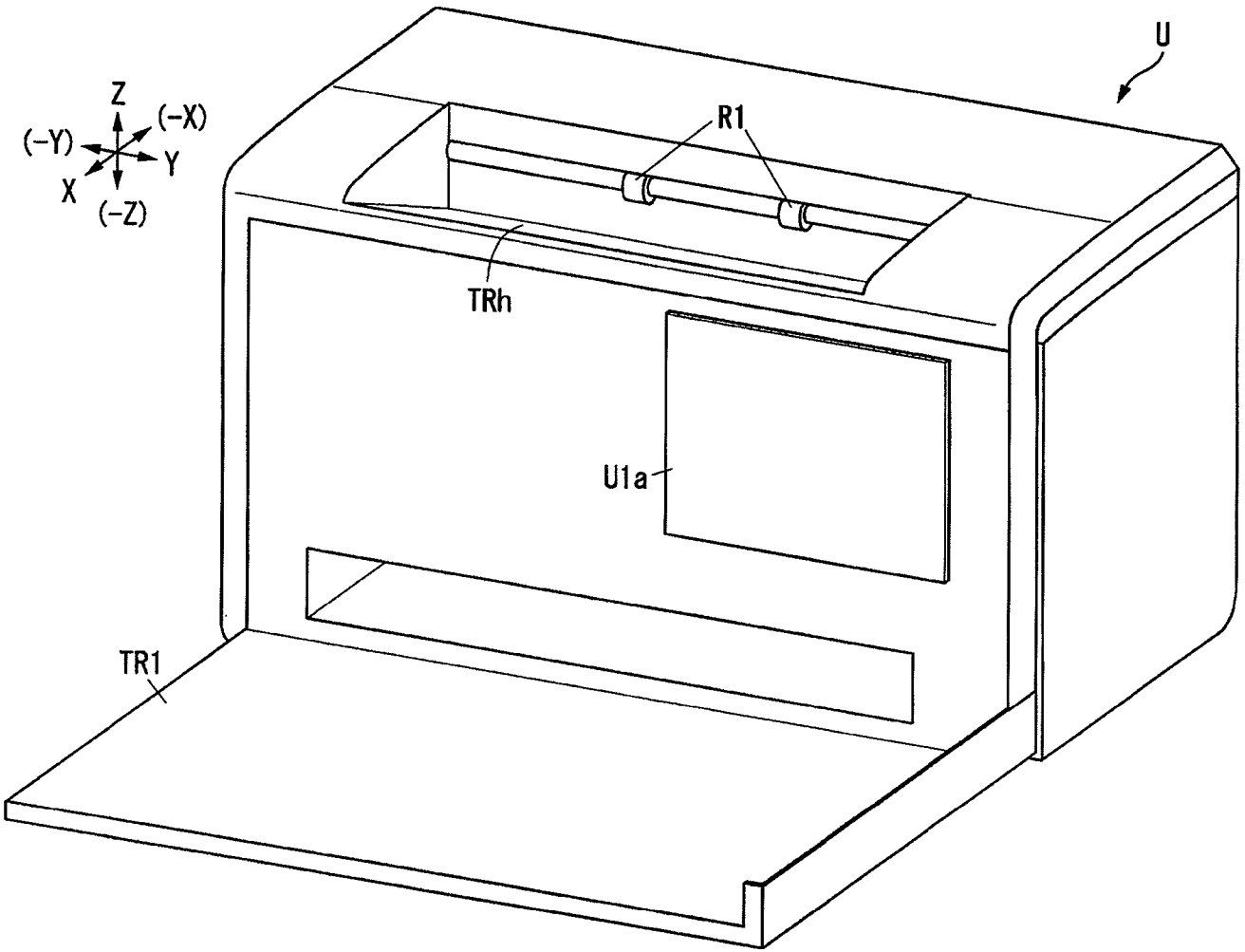
FIG. 1 is a perspective view of an image forming apparatus of exemplary embodiment 1.

Exemplary embodiments as specific examples of the mode for carrying out the invention will be discussed with reference to the accompanying drawings. However, the invention is not limited to the following exemplary embodiments.

For easy understanding of the description to follow, in the accompanying drawings, back and forth direction is X axis direction, side to side direction (left-right direction) is Y axis direction, and up and down direction is Z axis direction, and directions or sides indicated by arrows X, −X, Y, −Y, Z, and −Z are forward, backward, rightward, leftward, upward, and downward or front, rear (back), right, left, upper side (top), and lower side (bottom).

In the accompanying drawings, a mark including a dot described in a circle means an arrow from the back of the plane of the drawing to the surface and a mark including X described in a circle means an arrow from the surface of the plane of the drawing to the back.

In the description that follows using the accompanying drawings, members other than the members required for the description are not shown in the drawings where appropriate for easy understanding of the description.

Exemplary Embodiment 1

FIG. 1 is a perspective view of an image forming apparatus of exemplary embodiment 1.

In FIG. 1, a printer U as an example of the image forming apparatus of exemplary embodiment 1 is provided in a front lower part with a sheet feed tray TR1 as an example of a sheet feed section for storing a sheet S as an example of a medium. A discharge tray TRh is formed on an upper face of the printer U as an example of a discharge section to which the sheet S with an image recorded thereon is discharged. A front cover U1*a* is formed in a front right part of the printer U as an example of an open/closed section opened and closed when a toner cartridge as an example of a developer storage container described later is operated.

Figure 2:
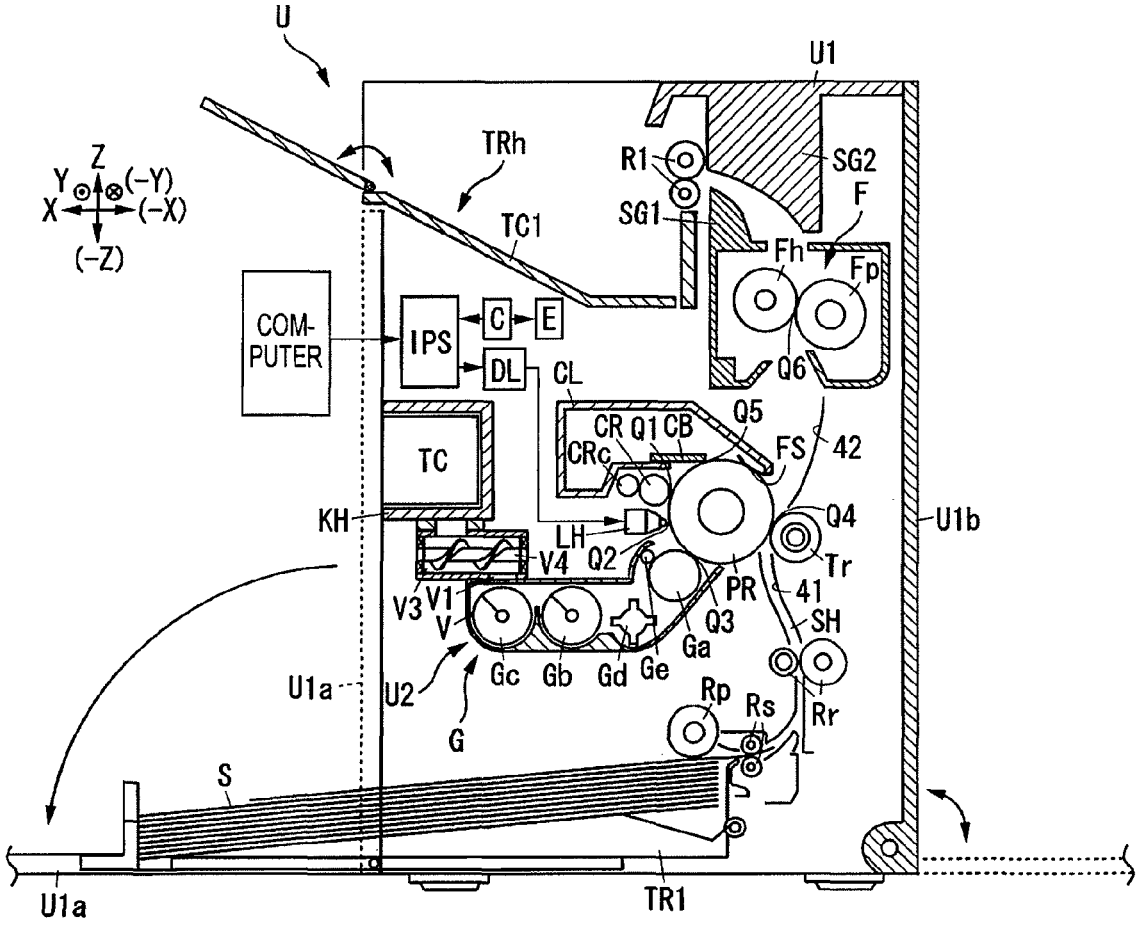
FIG. 2 is a general schematic representation of the image forming apparatus of Exemplary embodiment 1.

FIG. 2 is a general schematic representation of the image forming apparatus of exemplary embodiment 1.

In FIG. 2, the printer U has a controller C as an example of a control section, an image processing section IPS whose operation is controlled by the controller C, a laser drive circuit DL as an example of a latent image forming circuit, a power supply unit E, and the like. The power supply unit E applies a voltage to a charging roll CR as an example of a charger described later, a developing roller Ga as an example of a developing member, a transfer roller Tr as an example of a transfer member, and the like.

The image processing section IPS converts print information input from a computer, etc., as an example of an external information transmission apparatus into image information for forming a latent image and outputs the image information to the laser drive circuit DL at a preset timing. The laser drive circuit DL outputs a drive signal to a latent image forming unit LH in response to the input image information. The latent image forming unit LH of exemplary embodiment 1 is implemented as an LED head with LEDs as an example of latent image write elements placed linearly at preset intervals along the left-right direction.

A photoconductive body PR as an example of a rotating image holding body is supported in a back part of the printer U. The photoconductive body PR is surrounded by the charging roller CR, the latent image forming unit LH, a developing device G, the transfer roll Tr, and a photoconductive body cleaner CL as an example of a cleaner for the image holding body along the rotation direction of the photoconductive body PR.

In FIG. 2, a charging roll cleaner CRc as an example of a cleaner for the charger for cleaning the surface of the charging roll CR is opposed to and is in contact with the charging roll CR.

The developing device G has a developing container V in which a developer is stored. Placed in the developing container V are a developing roll Ga as an example of a developer holding body opposed to the photoconductive body PR, a pair of circulating conveying members Gb and Gc for circulating and conveying a developer while agitating the developer, a supply member Gd for conveying the developer agitated by the circulating conveying members to the developing roll Ga, and a layer thickness regulation member Ge for regulating the layer thickness of the developer on the surface of the developing roll Ga.

A developer supplying port V1 is formed on the front upper face of the developing container V as an example of a supplying member. A developer supplying passage V3 extending forward as an example of a developer conveying passage is joined to the developer supplying port V1. A supplying auger V4 as an example of a developer conveying member is rotatably supported in the developer supplying passage V3. A cartridge holder KH as an example of as attachment/detachment part where a toner cartridge TC is attached and detached is joined to the front end of the developer supplying passage V3, and a developer from the toner cartridge TC flows therein into. Therefore, when the supplying auger V4 is driven in response to the consumption amount of the developer in the developing device G, the developer is supplied from the toner cartridge TC to the developing device G.

The surface of the rotating photoconductive body PR is charged by the charging roll CR in a charging area Q1 and an electrostatic latent image is formed by latent image forming light emitted from the latent image forming unit LH at a latent image forming position Q2. The electrostatic latent image is developed to a toner image as an example of a visible image by the developing roll Ga in a developing area Q3 and the toner image is transferred to a record sheet S as an example of a medium by the transfer roll Tr in a transfer area Q4 formed by an opposed area of the photoconductive body PR and the transfer roll Tr. The remaining toner on the surface of the photoconductive body PR is removed by a cleaning blade CB as an example of a cleaning member in a cleaning area Q5 as an example of a cleaning area downstream of the transfer area Q4 and is collected in the photoconductive body cleaner CL.

A film sheet FS as an example of a scatter prevention member is provided on the opposed side of the cleaning blade CB and prevents the toner collected in the photoconductive body cleaner CL from spilling on the outside.

In FIG. 2, a pickup roll Rp as an example of a medium taking-out member is placed in the sheet feed tray TR1 in the lower part of the printer U. The record sheets S taken out by the pickup roll Rp are separated one sheet at a time by a separation roll Rs having a sheet feed roll and a retard roll as an example of a medium separation member, and each sheet is conveyed by a sheet conveying roll Ra as an example of a medium conveying member placed along a sheet conveying passage SH and is conveyed to the transfer area Q4 at a preset timing by a registration roll Rr as an example of a timing adjustment member placed upstream in the sheet conveying direction of the transfer area Q4.

The transfer roll Tr to which a transfer voltage is applied from the power supply unit E, etc., whose operation is controlled by the controller C transfers the toner image on the photoconductive body PR to the record sheet S passing through the transfer area Q4.

The record sheet S to which the toner image has been transferred in the transfer area Q4 is conveyed to a fixing unit F in a state in which the toner image is unfixed. The fixing unit F has a pair of fixing rolls Fh and Fp as an example of a fixing member and a fixing area Q6 is formed by a press contact area of the pair of fixing rolls Fh and Fp. The record sheet S conveyed to the fixing unit F has the toner image fixed by the pair of fixing rolls Fh and Fp in the fixing area Q6. The record sheet S formed with the fixed toner image is guided by sheet guides SG1 and SG2 as an example of a medium guide member and is discharged from a discharge roll R1 as an example of a discharge member to the discharge tray TRh on the upper face of a printer main body U1.

(Description of Cartridge Holder)

Figure 3:
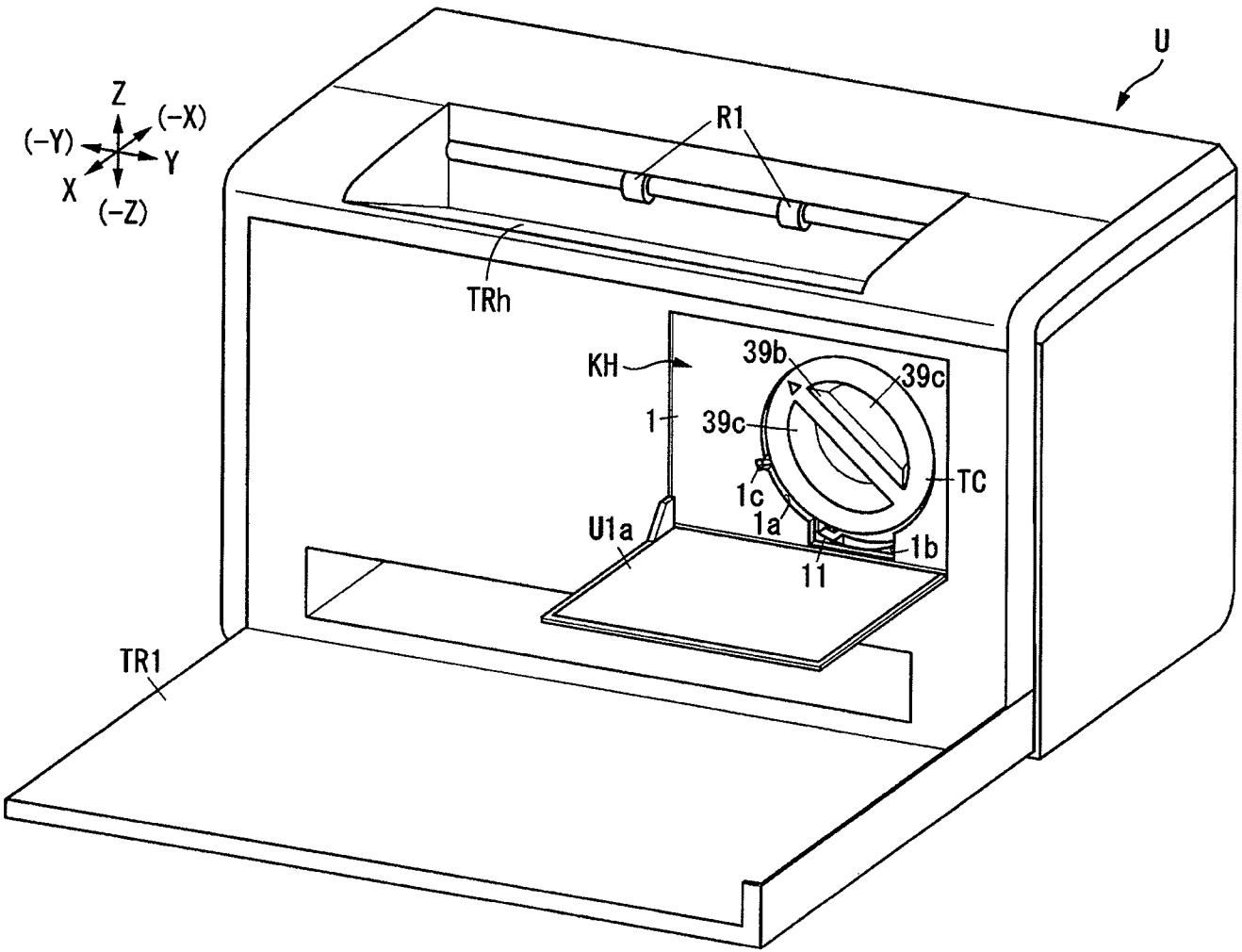
FIG. 3 is a schematic representation in a state in which a front cover of the image forming apparatus of exemplary embodiment 1 is opened.

FIG. 3 is a schematic representation in a state in which the front cover of the image forming apparatus of exemplary embodiment 1 is opened.

Figure 4:
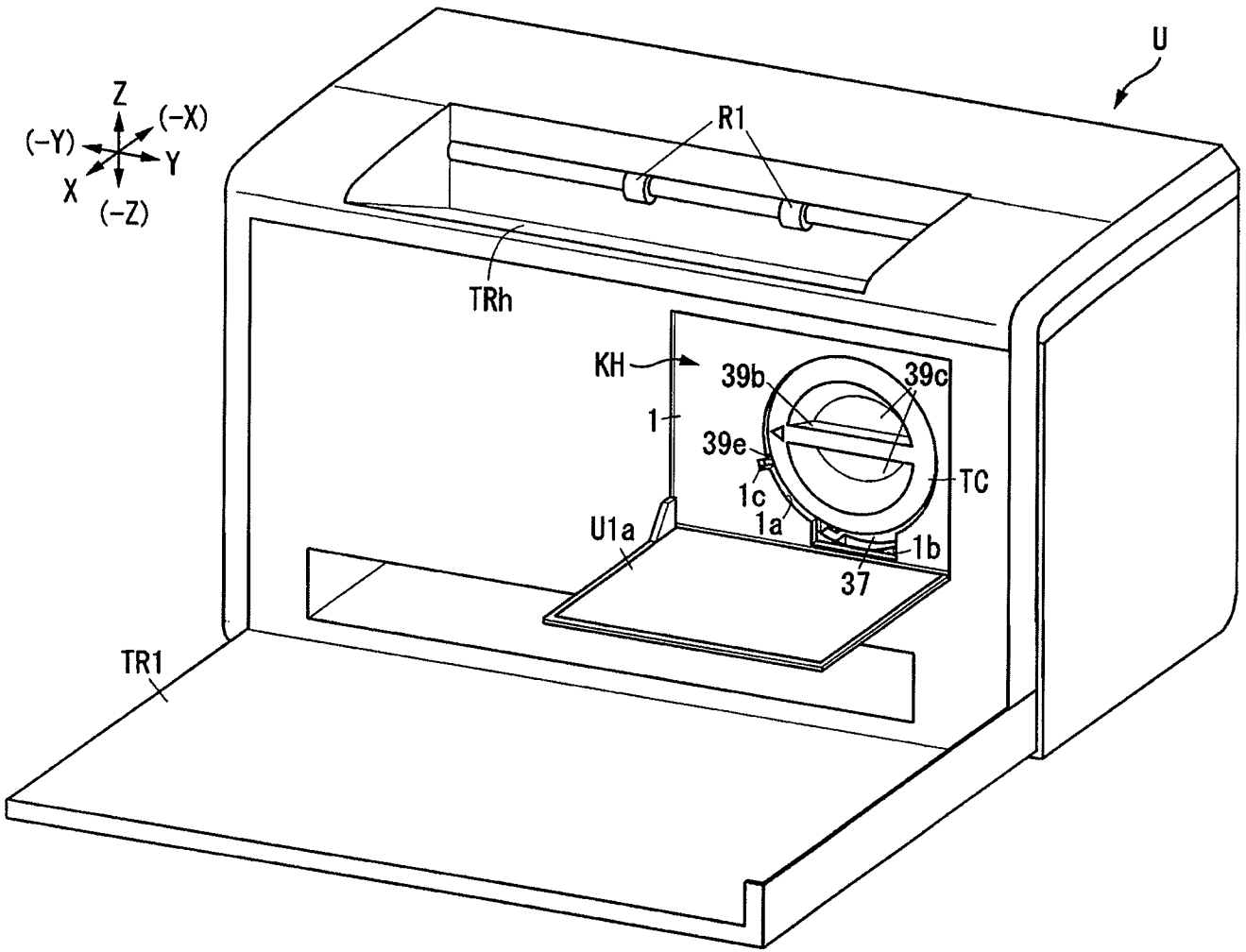
FIG. 4 is a schematic representation in a state in which a toner cartridge rotates and moved from an undetachable position shown in FIG. 3 to a detachable position.

FIG. 4 is a schematic representation in a state in which the toner cartridge rotates and moved from an undetachable position shown in FIG. 3 to a detachable position.

In FIGS. 1, 3, and 4, if the front cover U1*a* of the printer U of exemplary embodiment 1 is moved from a usual position shown in FIG. 1 to an operation position shown in FIGS. 3 and 4, the toner cartridge TC and the cartridge holder KH where the toner cartridge TC is placed are exposed to the outside.

Figure 5:
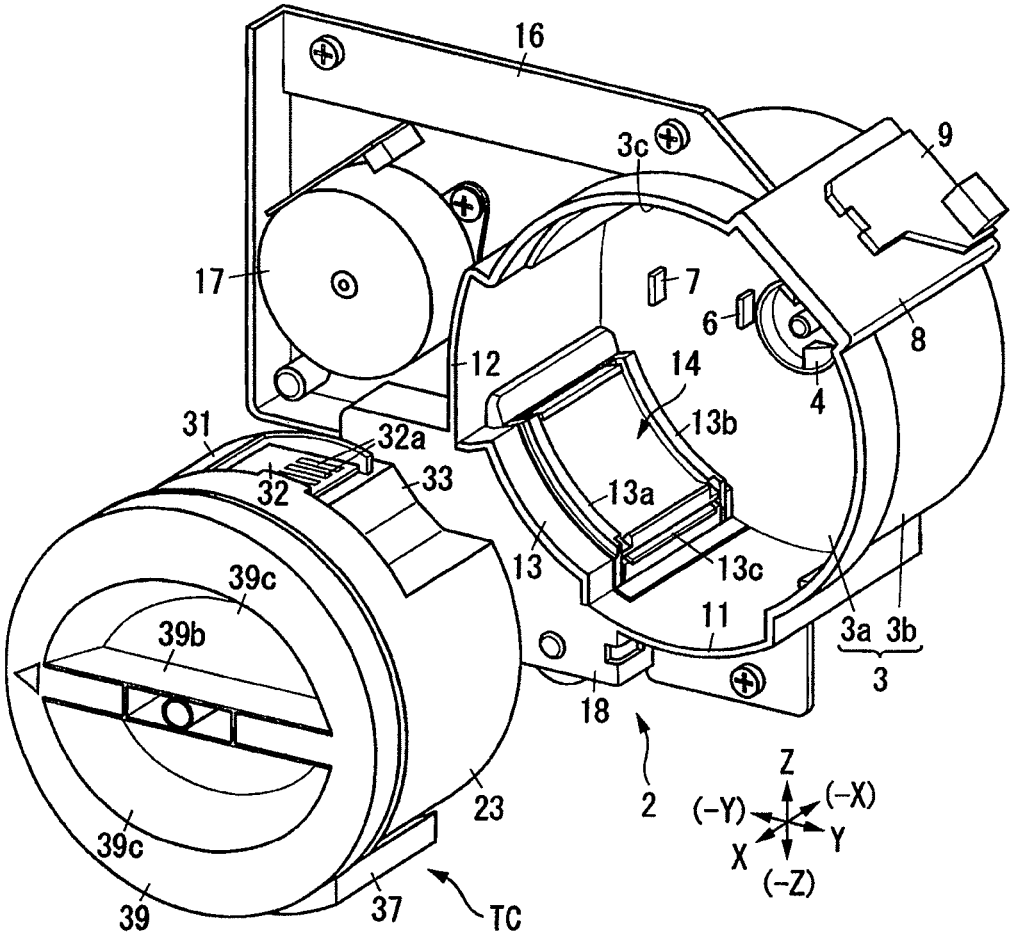
FIG. 5 is a main part schematic representation in a state in which the toner cartridge is removed from a cartridge holder.

FIG. 5 is a main part schematic representation in a state in which the toner cartridge is removed from the cartridge holder.

Figure 6:
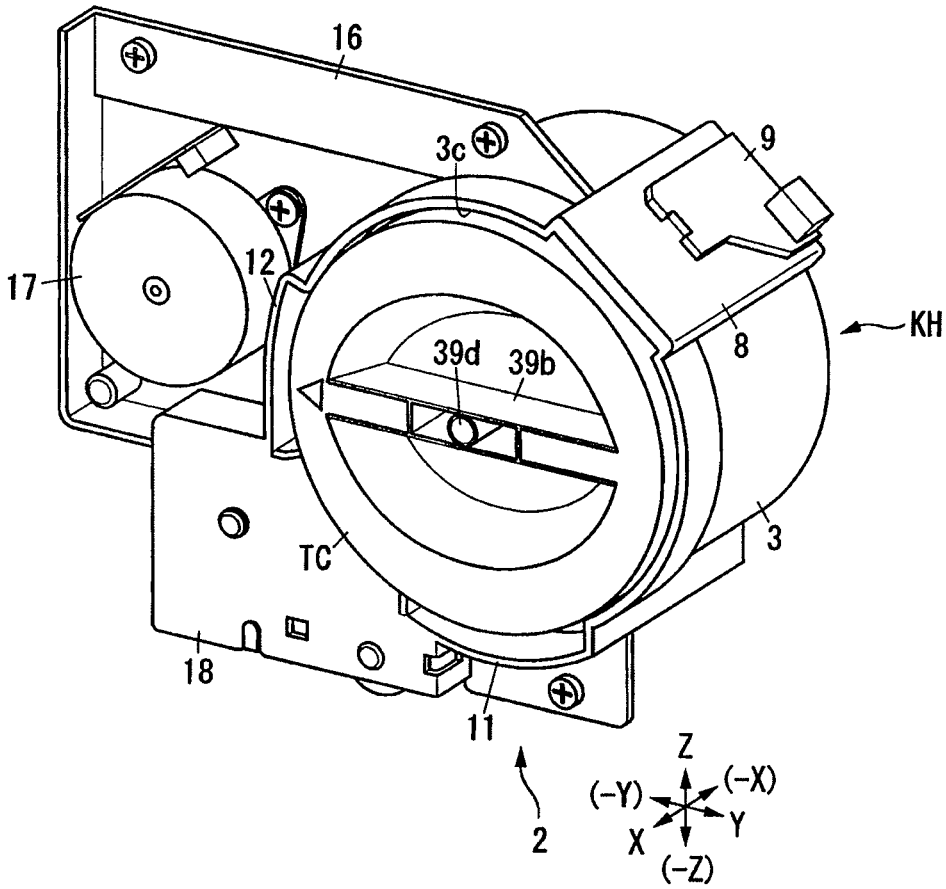
FIG. 6 is a main part schematic representation in a state in which the toner cartridge is placed in the cartridge holder.

FIG. 6 is a main part schematic representation in a state in which the toner cartridge is placed in the cartridge holder.

Figure 7:
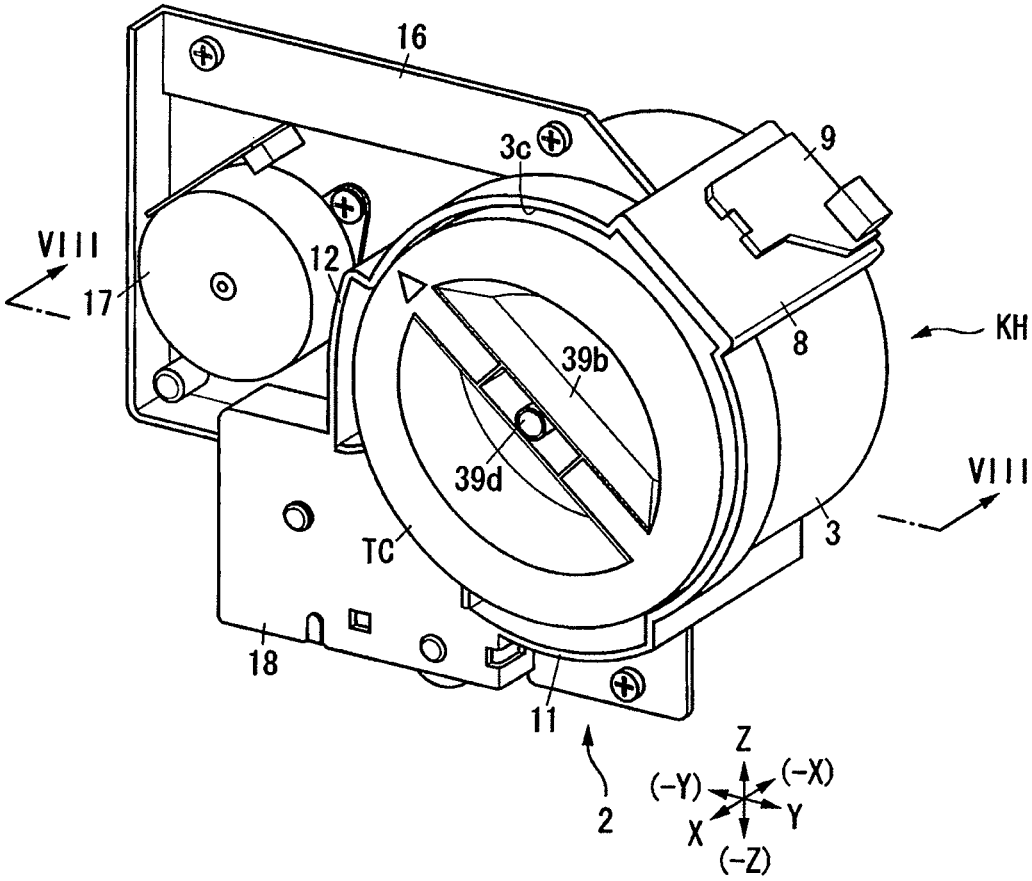
FIG. 7 is a schematic representation in a state in which the toner cartridge placed in the cartridge holder rotates to the undetachable position.

FIG. 7 is a schematic representation in a state in which the toner cartridge placed in the cartridge holder rotates to the undetachable position.

Figure 8:
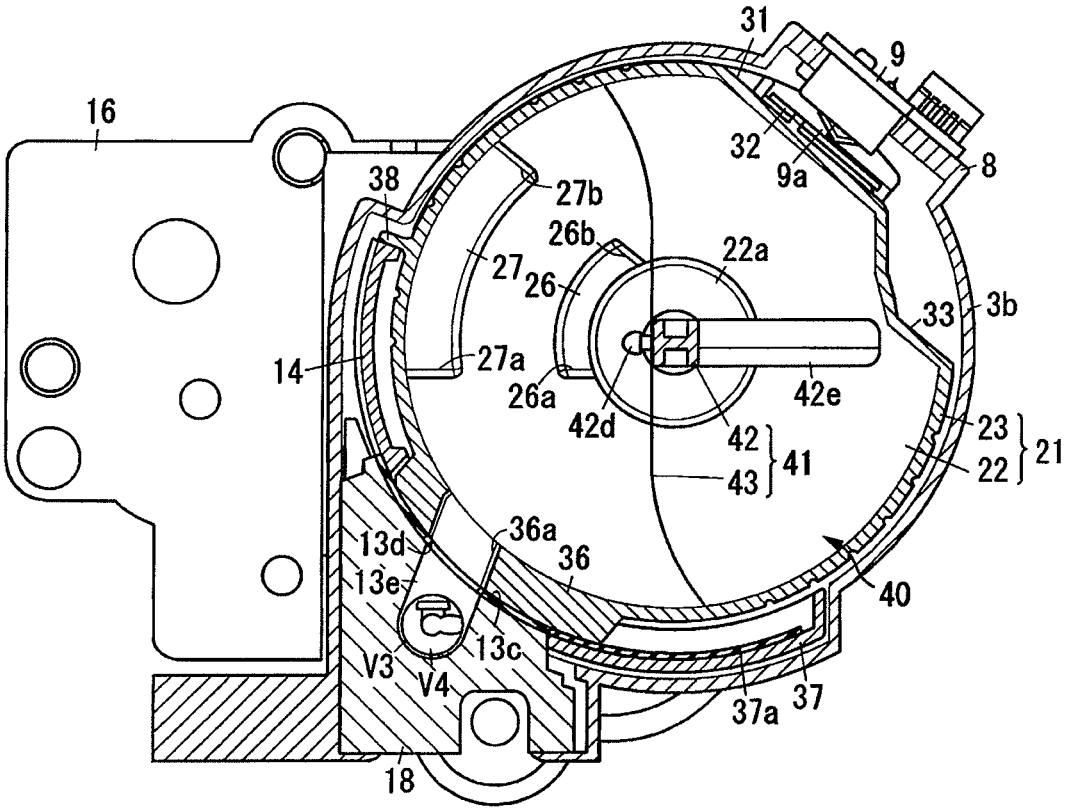
FIG. 8 is a sectional view taken on line VIII-VIII in FIG. 7.

FIG. 8 is a sectional view taken on line VIII-VIII in FIG. 7.

In FIGS. 3 and 4, the cartridge holder KH supported on the printer main body U1 as an example of an image forming apparatus main body has a front panel 1 as an example of a front member. The front panel 1 is formed with a circular-hole-shaped opening 1*a* where the toner cartridge TC is attached and detached. A shutter passage part 1*b* dented downward as an example of open/closed member passage part is formed at the lower end of the opening 1*a*. And a protrusion passage part 1*c* shaped like a cut is formed at the left of the opening 1*a*.

In FIGS. 5 to 8, a holder main body 2 as an example of an attachment/detachment section main body is supported in the front panel 1. The holder main body 2 has a cartridge storage section 3 formed as a cylindrical concave part with the back and forth direction of the cartridge attachment/detachment direction as the axial direction as an attachment/detachment section (which is an example of an attachment section).

In FIG. 5, the cartridge storage section 3 has a disk-like rear end wall 3*a* and a tubular wall 3*b* extending forward from the rear end wall 3*a*. A drive coupling 4 as an example of a drive transmission member is rotatably supported in the center of the rear end wall 3*a*. A pair of left and right positioning projections 6 and 7 projecting forward, upstream in the cartridge insertion direction as an example of convex part is formed at the left of the drive coupling 4.

In FIGS. 5 to 8, a reader support section 8 dented right upward relative to an inner peripheral surface 3*c* of the tubular wall 3*b* as an example of a read support section is formed in the upper right part of the tubular wall 3*b*. A CRUM reader 9 that can transmit and receive information and read and write information as an example of an information reader/writer is supported in the reader support section 8. In FIG. 8, the CRUM reader 9 has a connector 9*a* implemented as a plate spring projecting to the inside of the tubular wall 3*b* as an example of a contact terminal.

In FIGS. 5 to 8, a shutter storage section 11 dented downward relative to the inner peripheral surface 3*c* of the tubular wall 3*b*, namely, to the outside in the diametric direction of the tubular wall 3*b* as an example of an open/closed storage section is formed in a lower part of the tubular wall 3*b*.

A protrusion storage concave part 12 shaped like circular art, dented at the left relative to the inner peripheral surface 3*c* of the tubular wall 3*b*, namely, to the outside in the diametric direction of the tubular wall 3*b* as an example of a protrusion storage part is formed at the left of the tubular wall 3*b*.

In FIGS. 5 and 8, an inflow port part 13 extending along the circumferential direction of the tubular wall 3*b* is formed between the shutter storage section 11 and the protrusion storage concave part 12 of the tubular wall 3*b*. In FIG. 5, the inflow port part 13 is formed with a pair of back and forth shutter guides 13*a* and 13*b* as an example of a guide member, and an inflow port shutter 14 as an example of an inflow opening/closing member is supported movably along the circumferential direction of the tubular wall 3*b* between the shutter guides 13*a* and 13*b*.

In FIGS. 5 and 8, the inflow port part 13 has an inflow face 13*c* formed between the shutter guides 13*a* and 13*b* and formed like a step one step lower than the inner peripheral surface 3*c* of the tubular wall 3*b* and one step higher than an upper face of the shutter storage section 11.

In FIG. 8, the inflow face 13*c* is formed with an inflow port 13*d* below the inflow port shutter 14 and an inflow passage 13*e* extending downward from the inflow port 13*d*, and the lower end of the inflow passage 13*e* is connected to the upstream end of the developer supplying passage V3.

In FIGS. 5 to 8, a motor support plate 16 extending to the left as an example of a drive support member is supported in the cartridge storage section 3, and a cartridge motor 17 as an example of a drive source is supported in the motor support plate 16.

A gear support part 18 as an example of a transmission system support part is formed below the motor support plate 16. A gear train having a plurality of gears (not shown) for transmitting drive from the cartridge motor 17 to the drive coupling 4, the supplying auger V4, etc., is supported in the gear support part 18.

(Description of Toner Cartridge)

Figure 9:
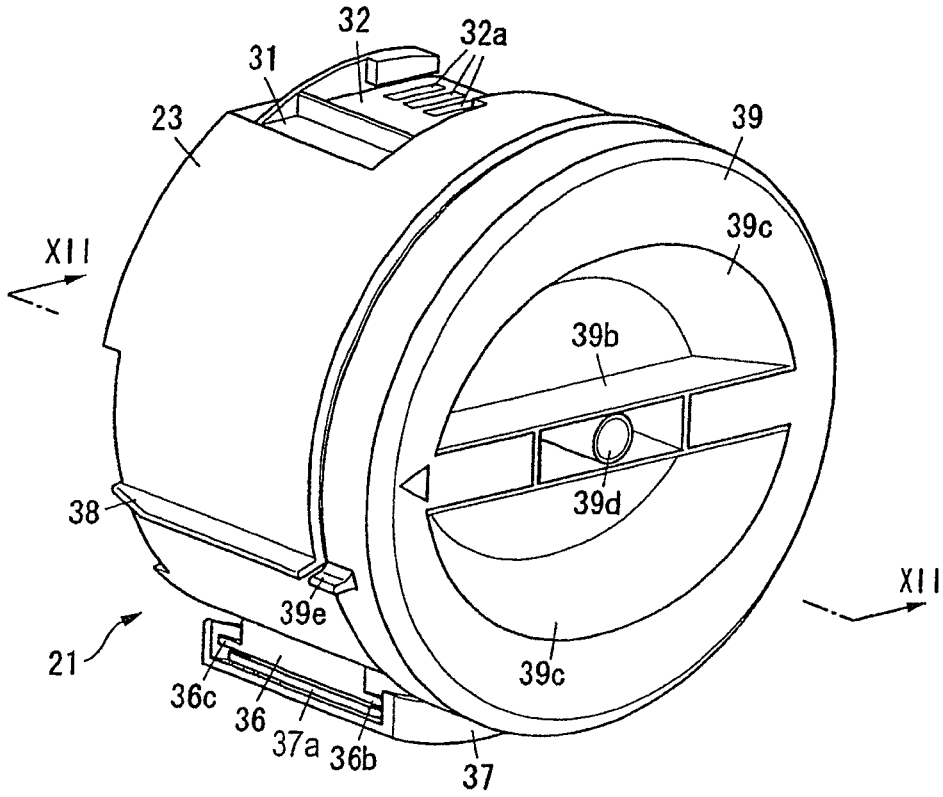
FIG. 9 is a perspective view of viewing the toner cartridge from the slanting front.

FIG. 9 is a perspective view of viewing the toner cartridge from the slanting front.

Figure 10:
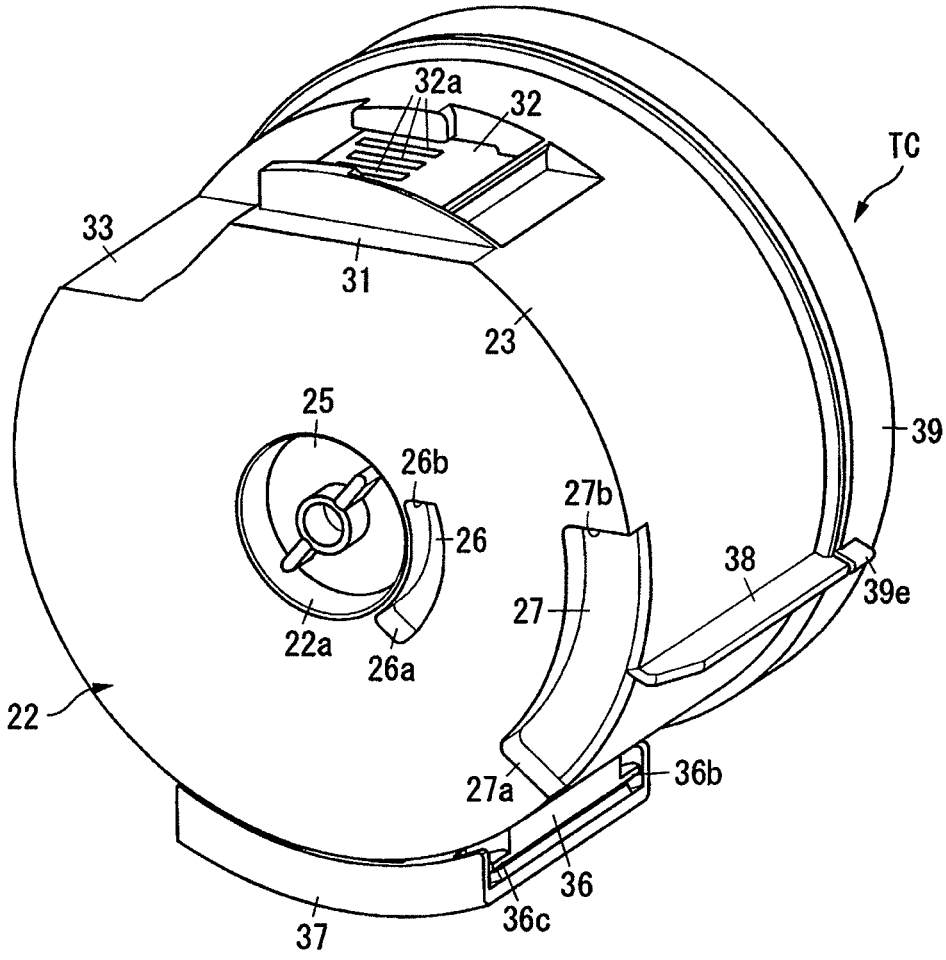
FIG. 10 is a perspective view of viewing the toner cartridge from the slanting rear.

FIG. 10 is a perspective view of viewing the toner cartridge from the slanting rear.

Figure 11:
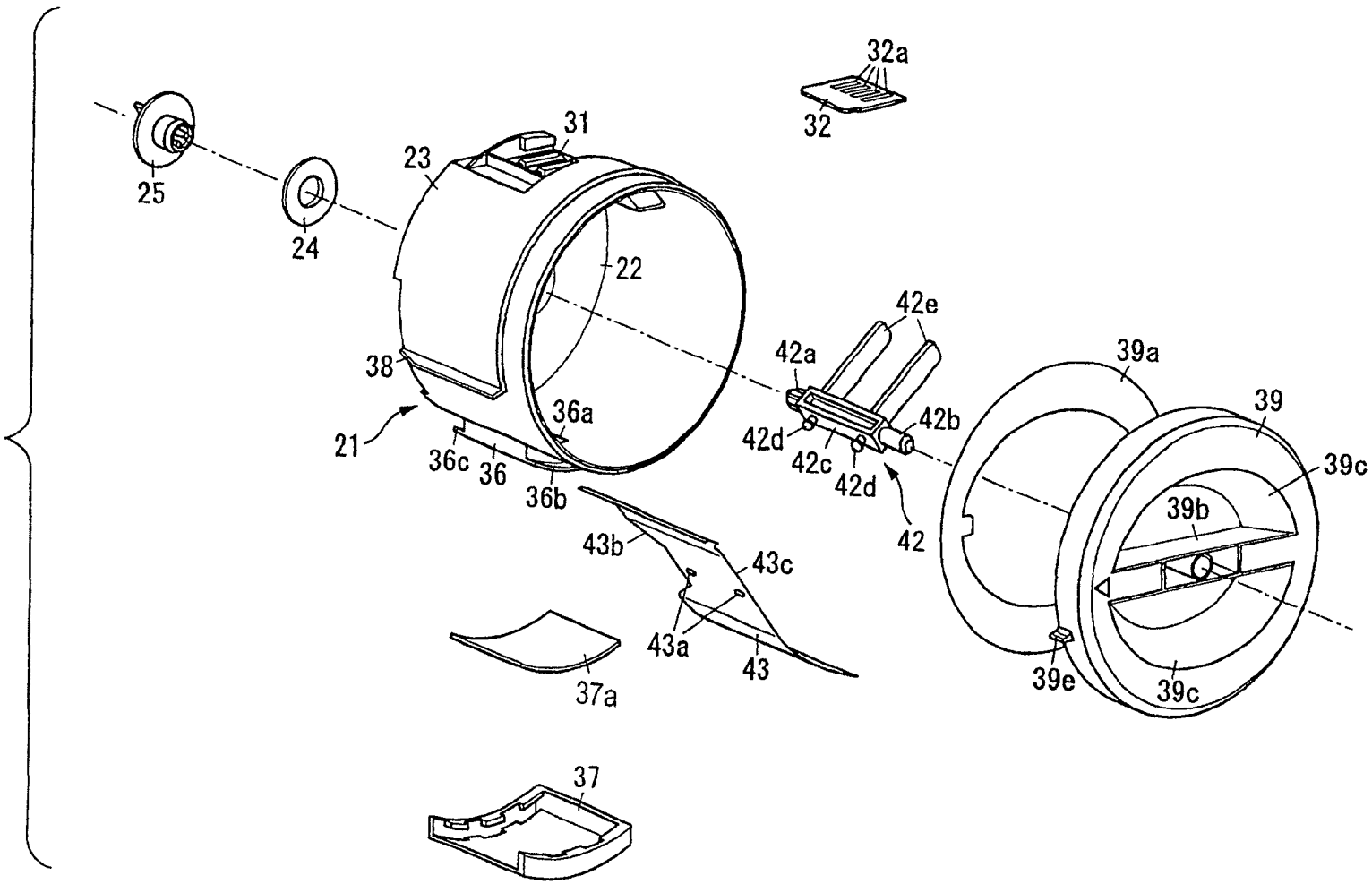
FIG. 11 is an exploded view of the toner cartridge.

FIG. 11 is an exploded view of the toner cartridge.

Figure 12:
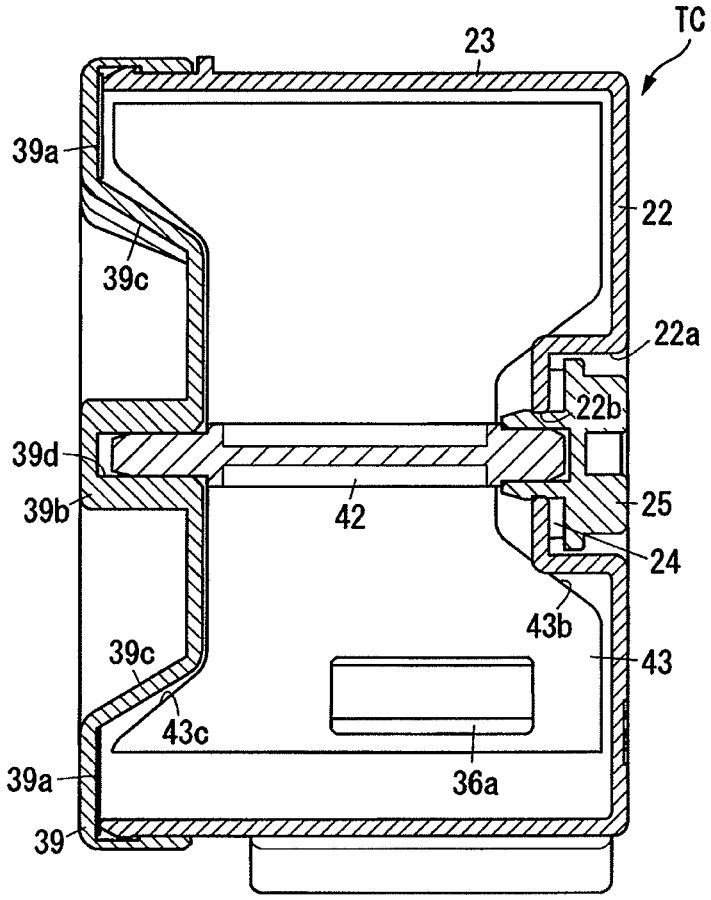
FIG. 12 is a sectional view taken on line XII-XII in FIG. 9.

FIG. 12 is a sectional view taken on line XII-XII in FIG. 9.

Figure 13:
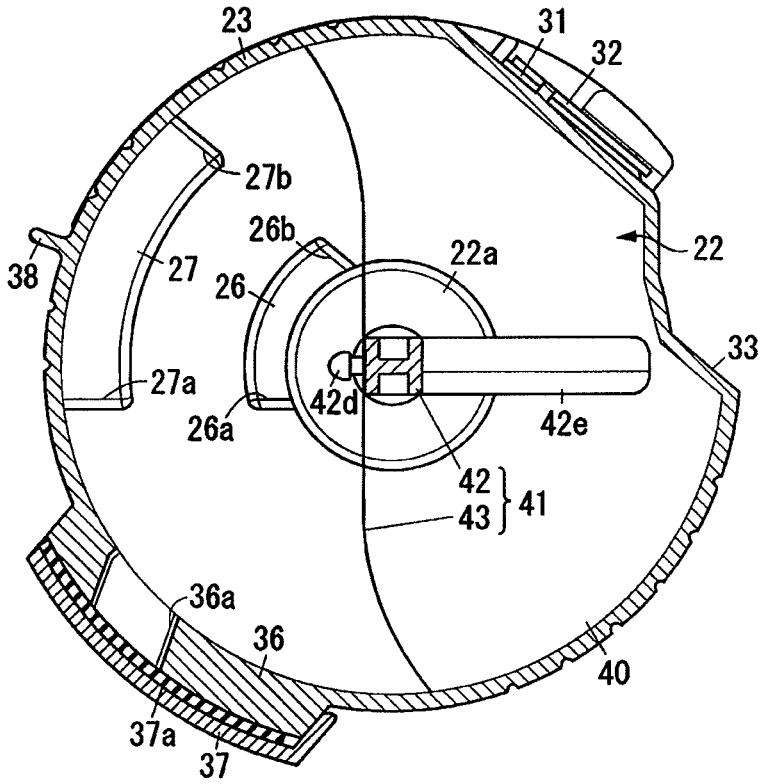
FIG. 13 is a sectional view of the toner cartridge portion in FIG. 8.

FIG. 13 is a sectional view of the toner cartridge portion in FIG. 8.

Figure 14:
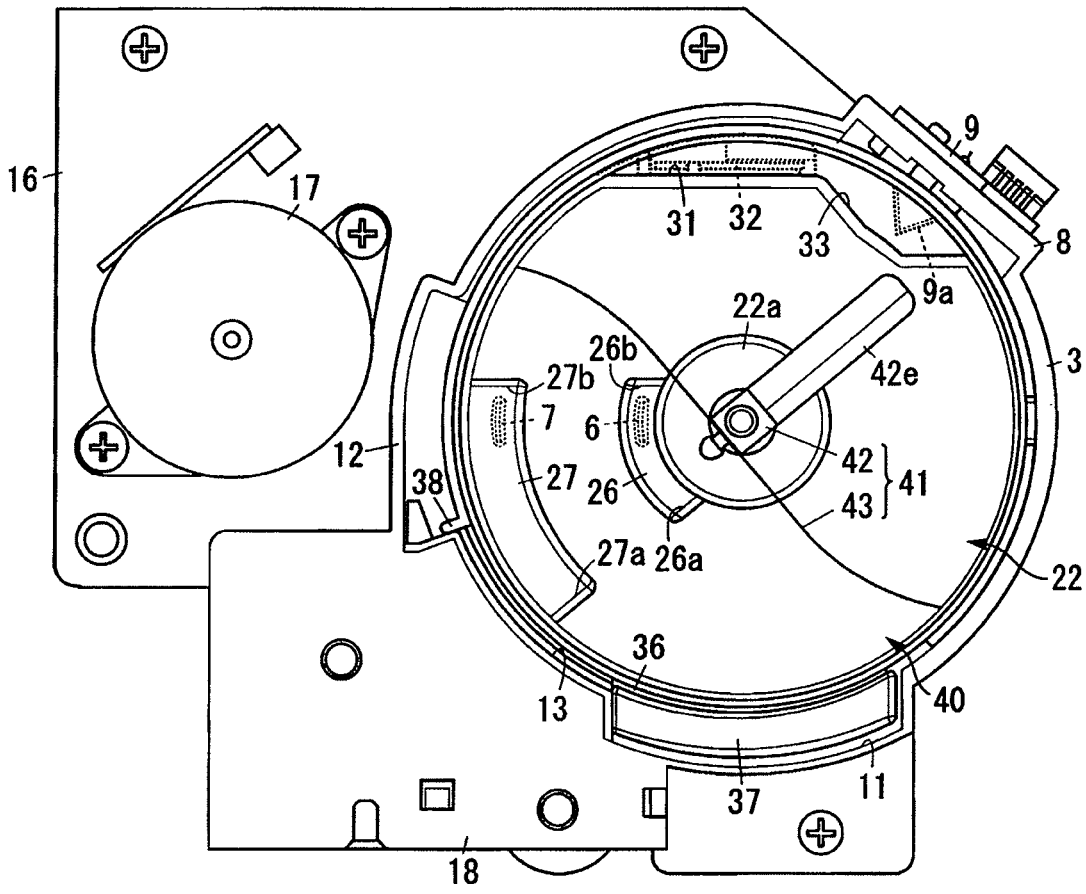
FIG. 14 is a main part schematic representation of the toner cartridge in a state in which it moves to a detachable position.

FIG. 14 is a main part schematic representation of the toner cartridge in a state in which it moves to a detachable position.

Figure 15:
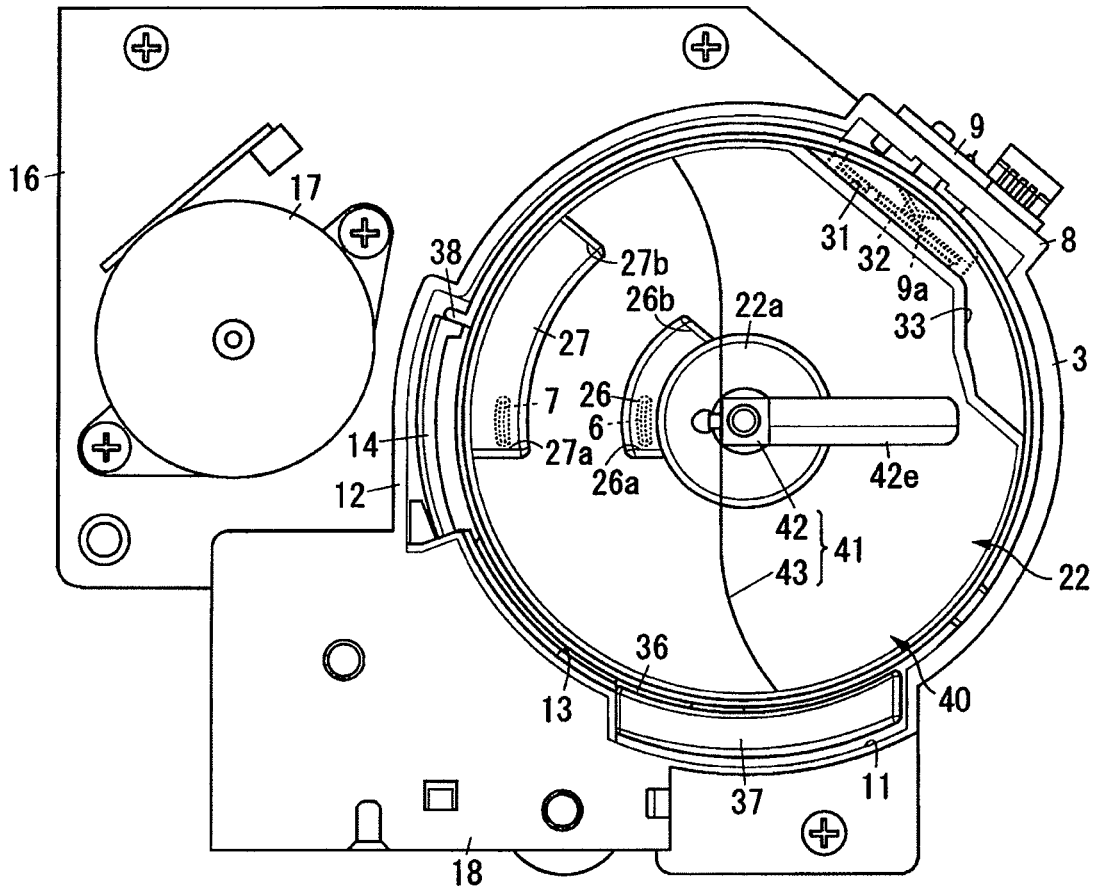
FIG. 15 is a main part schematic representation of the toner cartridge in a state in which it moves to an undetachable position.

FIG. 15 is a main part schematic representation of the toner cartridge in a state in which it moves to an undetachable position.

FIGS. 14 and 15 are schematic representations in a state in which the toner cartridge is viewed from the front in a state in which a cartridge cover is removed at the detachable position or the undetachable position.

In FIGS. 5 to 15, the toner cartridge TC attached to and detached from the cartridge holder KH has a cylindrical cartridge main body 21 having a rotation shaft extending in the insertion direction or the back and forth direction of the attachment/detachment direction as an example of a container main body. The cylindrical cartridge main body 21 has a tube part 22+23 made up of a disk-like rear end wall 22 as an example of a bottom wall formed ahead in the insertion direction or at the rear end in the back and forth direction and a tubular wall 23 extending forward from the rear end wall 22. In FIGS. 10 and 12, a cylindrical transmission storage section 22*a* dented to the front is formed in the center of the rear end wall 22 and an opening 22*b* piercing in the back and forth direction is formed in the transmission storage section 22*a*. In FIG. 11, in the transmission storage section 22*a*, a driven coupling 25 meshing with the drive coupling 4 as an example of a transmitted member through a coupling seal 24 as an example of a leakage prevention member is supported in the opening 22*b* for rotation.

In FIGS. 8, 10, and 12 to 15, the rear end wall 22 is formed with positioning grooves 26 and 27 in a forward dent shape upstream in the insertion direction or the attachment direction corresponding to the positioning projections 6 and 7 as an example of a turn stop part. The positioning grooves 26 and 27 of exemplary embodiment 1 each has a circular arc shape being concentric with the opening 22*a* of the center of the rear end wall 22 as the center and are formed so as to be able to engage the positioning projections 6 and 7.

In exemplary embodiment 1, the central angles of the positioning grooves 26 and 27 each like a circular arc are set to the same and the central angle is set corresponding to the rotation angle at which the toner cartridge TC rotates between an unlock position as an example of the detachable position shown in FIGS. 4 and 14 and a positioning position as an example of the undetachable position shown in FIGS. 3 and 15. However, it may be set large at a predetermined angle on the opposite side to the positioning position from the detachable position. Further, the central angles of the positioning grooves 26 and 27 each like a circular arc may be set to different angles. As other examples of the undetachable position, a position rotated only at an arbitrary angle, the position before the toner cartridge TC rotated toward the positioning position from the detachable position reaches the positioning position, a position rotated only at an arbitrary angle toward the opposite side to the positioning position from the detachable position, and the like exist.

As shown in FIGS. 14 and 15, the positioning projections 6 and 7 are held in a state in which they are in contact with or are in a slight spacing from upper end faces 26*b* and 27*b* in the diametric direction toward the rotation center on the upper end sides of the circular arcs of the positioning grooves 26 and 27 into which the positioning projections 6 and 7 are fitted at the unlock position shown in FIG. 14. Further, at the positioning position shown in FIG. 15, they are held in a state in which they are in contact with lower end faces 26*a* and 27*a* in the diametric direction toward the rotation center on the lower end sides of the circular arcs of the positioning grooves 26 and 27.

The positioning grooves 26 and 27 of exemplary embodiment 1 are formed so as to position on a side relative to the rotation center when the toner cartridge TC is rotated to the unlock position, the positioning position, etc. In exemplary embodiment 1, the rotation center is roughly the same as the rotation center where the driven coupling 25 is supported in the opening 22*b* for rotation. At the unlock position shown in FIG. 14, the upper end faces 26*b* and 27*b* are set roughly horizontal in the direction of nine o'clock of a clock. At the positioning position shown in FIG. 15, the lower end faces 26*a* and 27*a* are set so as to become roughly horizontal. Therefore, at the positioning position shown in FIG. 15, the upper end faces 26*b* and 27*b* are set are set so as to be inclined downward in the gravity direction as they are toward the rotation center.

In FIGS. 5, 8 to 11, and 13 to 15, a CRUM holding section 31 dented inward relative to an outer peripheral surface 23*a* of the tubular wall 23 as an example of a storage member holding section is formed at the upper end of the tubular wall 23. CRUM (Customer Replaceable Unit Memory) 32 formed of a circuit board as an example of an information storage member is placed in the CRUM holding section 31. The CRUM 32 stores information concerning the toner cartridge such as the compatible model with the toner cartridge TC, the initial fill amount of an internal developer, the remaining amount decreased with use of the developer, whether or not the developer is close to running out, and whether or not the developer runs out.

In FIGS. 9 and 10, the CRUM 32 has a connector part 32*a* with which the connector 9*a* of the CRUM reader 9 comes in contact as an example of a contact terminal. At the positioning position shown in FIG. 15, the CRUM 32 comes in contact with the connector 9*a* and the information stored in the CRUM 32 can be read and written. As for contact between the connector part 32*a* of the CRUM 32 and the connector 9*a* of the CRUM reader 9, more particularly, the connector part 32*a* of the CRUM 32 comes in contact with the connector 9*a* of the CRUM reader 9 at a position at which the toner cartridge TC is rotated toward the positioning position and is rotated only at a predetermined angle, the position before the toner cartridge TC reaches the positioning position. Then, further when the toner cartridge TC is rotated toward the positioning position, the lower end faces 26*a* and 27*a* of the positioning grooves 26 and 27 of the toner cartridge TC come in contact with the positioning projections 6 and 7 and the position in the rotation direction of the toner cartridge TC is determined.

A connector relief part 33 dented inward relative to the outer peripheral surface 23*a* as an example of an interference prevention part is formed at the light of the CRUM holding section 31. The connector relief part 33 is formed to prevent the tubular wall 23 from coming in contact with the connector part 9*a* of the CRUM reader 9 and causing damage to the connector part 9*a*, etc., when the toner cartridge TC is inserted into the cartridge storage section 3.

In FIGS. 8 to 11, an outflow port part 36 projecting downward, outward in the diametric direction from the outer peripheral surface 23*a* of the tubular wall 23 is formed corresponding to the shutter storage section 11 in the lower end part of the tubular wall 23. In FIGS. 8 and 13, the outflow port part 36 is formed with an outflow port 36*a* connecting the inner face and the outer face of the tubular wall 23. The outflow port 36*a* is connected to the inflow port 13*d* at the positioning position shown in FIGS. 8 and 15. As shown in FIG. 13, the outflow port 36*a* of exemplary embodiment 1 is formed so as to be inclined downward relative to the diametric direction of the tubular wall 23 and clogging of the developer flowing out from the outflow port 36*a* in the outflow port 36*a* is decreased.

In FIGS. 9 and 10, the outflow port part 36 is formed with shutter guides 36*b* and 36*c* hanging over to the outside in the back and forth direction in both back and forth end margins of the lower end and extending along the circumferential direction of the tubular wall 23, and an outflow port shutter 37 as an example of an open/closed member is supported in the shutter guides 36*b* and 36*c*. In FIGS. 11 and 13, for the outflow port shutter 37, a cartridge seal 37*a* as an example of a leakage prevention member is supported on the face opposed to the outflow port 36*a*.

In FIG. 8, in exemplary embodiment 1, the thickness of the outflow port shutter 37 is formed as the thickness corresponding to the step difference between the shutter storage section 11 and the inflow face 13*c*.

In FIGS. 8 to 11 and 13 to 15, a rib 38 extending in the back and forth direction projecting to the left, outward in the diametric direction as an example of a protrusion part and an example of an association block part is formed in the left part of the tubular wall 23. The rib 38 is formed corresponding to the protrusion storage concave part 12 and is set so as to be stored in the protrusion storage concave part 12 in a state in which the toner cartridge TC is placed in the cartridge storage section 3.

In FIGS. 5 to 7, 9, 11, and 12, a cartridge cover 39 for closing the front end of the tube part 22+23 as an example of a lid member is placed back in the insertion direction of the cartridge main body 21 or at the front end in the back and forth direction relative to the back and forth direction of attachment/detachment direction or the insertion direction of the toner cartridge TC. In FIGS. 11 and 12, a cover seal 39*a* as an example of a leakage prevention member placed is placed between the cartage cover 39 and the front end of the tubular wall 23 of the cartridge main body 21. The cartridge cover 39 is formed with a handle 39*b* extending in the left-right direction on the front as an example of an operation part. A semiconic handle concave part 39*c* dented backward relative to the insertion direction of the toner cartridge TC as an example of an operation concave part is formed on both up and down sides of the handle 39*b*. In FIG. 12, the handle 39*b* is formed with a bearing part 39*d* shaped like a circular hole dented forward from the back face relative to the insertion direction of the toner cartridge TC as an example of a shaft support part. In FIGS. 9 to 11, a front rib 39*e* formed corresponding to the rib 38 and extending in the back and forth direction as an example of a registration part is formed on the outer peripheral surface of the cartridge cover 39. Therefore, to assemble the cartridge cover 39 to the cartridge main body 21, they are assembled so that the rib 38 and the front rib 39*e* match, whereby the position of the handle 39*b* can be placed at the preset position. The space surrounded by the cartridge main body 21 and the cartridge cover 39 forms the developer storage chamber 40 storing a developer.

In FIGS. 8 and 11 to 15, an agitator 41 as an example of a developer conveying member is housed in the developer storage chamber 40. The agitator 41 has a rotation shaft 42 extending in the back and forth direction relative to the insertion direction of the toner cartridge TC. A rear end 42*a* of the rotation shaft 42 is joined to the driven coupling 25 and a front end 42*b* is supported on the bearing part 39*d* for rotation. Therefore, when drive from the cartridge motor 17 is transmitted, the rotation shaft 42 is supported in a rotatable state.

The rotation shaft 42 has a center part 42*c* formed like a prism extending in the back and forth direction. A pair of back and forth mushroom-shaped film fixing projections 42*d* apart in the back and forth direction as an example of a fixing part for a conveying member is formed on one face side of the prism of the center part 42*c*. A rod-like agitation part 42*e* extending in the diametric direction from the center part 42*c* is formed on an opposite face on the opposed side to the film fixing projections 42*d*. When the rotation shaft 42 rotates, the agitation part 42*e* rotates integrally and agitates the developer in the developer storage chamber 40 and breaks down a massive developer.

In FIGS. 11 and 12, a conveying film 43 formed of a thin-film flexible member as an example of a developer conveying member is supported on the film fixing projections 42*d* of the rotation shaft 42. In FIG. 11, for the conveying film 43, an attachment hole 43*a* as an example of a fixed part formed in the center is supported in a state in which it pierces, and rotates integrally with the rotation shaft 42. In FIG. 12, a back cut part 43*b* shaped like a trapezoid cut corresponding to the transmission storage section 22*a* is formed in the back end part of the conveying film 43 relative to the insertion direction of the toner cartridge TC, and a front cut part 43*c* shaped like a trapezoid formed along the inner face of the handle concave part 39*c* is formed in the front end part relative to the insertion direction of the toner cartridge TC. Therefore, when the rotation shaft 42 rotates, the conveying film 43 comes in contact with the inner peripheral surface of the tubular wall 23 and conveys a developer toward the outflow port 36*a* in an elastically deformed state. In exemplary embodiment 1, the conveying film 43 is formed on both sides rather than only one side in the diametric direction of the rotation shaft 42; at one revolution, a developer is twice conveyed to the outflow port 36*a* and the amount per unit time of the developer flowing out from the outflow port 36*a*, the dispense rate is easily stable.

(Operation of Exemplary Embodiment 1)

In the printer U of exemplary embodiment 1 including the configuration described above, when the toner cartridge TC is placed in the cartridge holder KH, it is moved in the placement (attachment) direction of the back direction from the distant position shown in FIG. 5 and is moved to the placement (attachment) position shown in FIG. 6.

At this time, if the positions of the outflow port part 36 and the outflow port 25 shutter 37 and the position of the shutter storage section 11 match and the positions of the rib 38 and the front rib 39*e* and the position of the protrusion storage concave part 12 do not match, the toner cartridge TC is not placed. Particularly, the widths of the outflow port part 36 and the outflow port shutter 37 and the shutter storage section 11 in the left-right direction and the circumferential direction are formed corresponding to each other for preventing erroneous placement (attachment) at the positioning position shown in FIG. 15.

When the toner cartridge TC is moved to the placement position, the positioning projections 6 and 7 are fitted into the positioning grooves 26 and 27. Therefore, if the positions of the positioning projections 6 and 7 are fitted into the positioning grooves 26 and 27 or the number thereof differ in response to the model of the image forming apparatus, the color or the type of developer stored in the toner cartridge TC, etc. . . . , the positioning projections 6 and 7 are not fitted into the positioning grooves 26 and 27 and interfere with them and placing of an erroneous toner cartridge TC is prevented.

In FIGS. 6 and 14, when the toner cartridge TC is placed in the cartridge holder KH, the drive coupling 4 and the driven coupling 25 mesh with each other and the outflow port part 36 and the outflow port shutter 37 are stored in the shutter storage section 11. At this time, as shown in FIG. 14, the positioning projections 6 and 7 are placed in the proximity of the upper end faces 26*b* and 27*b* of the positioning grooves 26 and 27.

When the toner cartridge TC is rotated from the placement position and the unlock position shown in FIGS. 6 and 14 to the positioning position shown in FIGS. 7 and 15, the positioning projections 6 and 7 and the positioning grooves 26 and 27 rotate relatively. When the toner cartridge TC moves to the positioning position as shown in FIG. 15, the positioning projections 6 and 7 come in contact with the lower end faces 26*a* and 27*a* of the positioning grooves 26 and 27 and the move to the positioning position is complete. Therefore, the positioning projections 6 and 7 and the positioning grooves 26 and 27 engage, so that erroneous placement of toner cartridge can be prevented and the rotation position can be regulated.

In FIGS. 8 and 13, when the toner cartridge TC moves from the unlock position to the positioning position, the outflow port part 36 rotates in an opposed state to the inflow face 13*c*; the outflow port shutter 37 comes in contact with the step difference between the shutter storage section 11 and the inflow face 13*c* and rotation is regulated. Therefore, the outflow port shutter 37 rotates relatively to the outflow port part 36, and the outflow port shutter 37 moves relatively to the outflow port part 36 from the closed position at which the outflow port 36*a* is closed as shown in FIG. 13 to the opened position at which the outflow port 36*a* is opened shown in FIG. 8.

At this time, the inflow port shutter 14 is pushed to the left end face of the moving outflow port part 36 and moves from the closing position closing the inflow port 13*d* shown in FIG. 5 to the opening position opening the inflow port 13*d* shown in FIG. 8. At this time, the inflow port shutter 14 moves to the opening position in a state in which it is pinched by the outflow port part 36 and the rib 38 and the front rib 39*e*.

When the move of the toner cartridge TC to the positioning position is complete, the shutter 14 moves to the opening position and the outflow port shutter 37 moves to the opened position, the outflow port 36*a* and the inflow port 13*d* are connected, and the developer in the toner cartridge TC can be supplied to the developing device G.

At the positioning position, the outflow port part 36 is sandwiched back and forth between the shutter guides 13*a* and 13*b* of the inflow port part 13 and the toner cartridge TC is held and positioned in a state in which it cannot move forward.

At the positioning position, when drive is transmitted from the cartridge motor 17 as an image is formed, the agitator 41 and the supplying auger V4 rotate, the developer in the developer storage chamber 40 flows out from the outflow port part 36, and the developer is supplied through the developer supplying passage V3 to the developing device G.

In the toner cartridge TC of exemplary embodiment 1, the positioning grooves 26 and 27 are dented to the inside of the developer storage chamber 40 and if the flexible conveying film 43 rotates in a state in which it becomes elastically deformed in the portions corresponding to the lower end walls 26*a* and 27*a* of the positioning grooves, and arrives at the inner face corresponding to the upper end walls 26*b* and 27*b* and is elastically restored, there is a possibility that a space with which the conveying film 43 does not come in contact, a dead space may occur in the inner face corresponding to the upper end walls 26*b* and 27*b*. At the positioning position, if the upper end walls 26*b* and 27*b* are formed upward or horizontally as they are toward the rotation shaft 42, it is feared that the developer stored in the inner face corresponding to the upper end walls 26*b* and 27*b* may be unused and may become fruitless. In contrast, in exemplary embodiment 1, the positioning grooves 26 and 27 are placed on a side relative to the center of the disk-like rear end wall 22 of the rotation center of the cartridge main body 21 at the undetachable position and the inner face corresponding to the upper end walls 26*b* and 27*b* is inclined downward as the inner face is toward the rotation shaft 42; a developer easily drops naturally into the developer storage chamber 40 because of gravity, vibration at the passage time of the conveying film 43, at the motor drive time, etc., and occurrence of unused developer is decreased. That is, accumulation of the developer in the inner portions of the positioning grooves 26 and 27 is decreased.

Likewise, in exemplary embodiment 1, the connector relief part 33 is formed in the upper end part and accumulation of the developer therein is decreased.

To remove the toner cartridge TC because the developer in the developer storage chamber 40 runs out, etc., first the toner cartridge TC is rotated from the positioning position shown in FIGS. 7, 8, 15, etc., to the unlock position shown in FIGS. 6, 14, etc.

When the toner cartridge TC rotates from the positioning position to the unlock position, the positioning projections 6 and 7 and the positioning grooves 26 and 27 rotate relatively. When the toner cartridge TC moves to the unlock position, the positioning projections 6 and 7 are close to and come in contact with the upper end faces 26*b* and 27*b* of the positioning grooves 26 and 27 and the move to the unlock position is complete, as shown in FIG. 14.

In FIGS. 8 and 13, when the toner cartridge TC moves from the positioning position to the unlock position, the outflow port shutter 37 is held in a state in which it cannot move in the rotation direction in the shutter storage section 11. In other word, the outflow port shutter 37 moves relatively to the outflow port part 36, and the outflow port shutter 37 moves relatively to the outflow port part 36 from the opened position to the closed position. At this time, the inflow port shutter 14 is pushed by the rib 38, etc., of the rotating toner cartridge TC and moves from the opening position to the closing position. Therefore, when the toner cartridge TC moves from the positioning position to the unlock position, the shutters 14 moves to the closing position, the outflow port shutter 37 moves to the closed position and the inflow port 13*d* and the outflow port 36*a* are closed.

In a state in which the toner cartridge TC moves to the unlock position, the rotating outflow port part 36 is away from the shutter guides 13*a* and 13*b* and positioning is released. Therefore, the toner cartridge TC can be moved in the detachment direction (forward) and can be removed and replaced.

Figure 16:
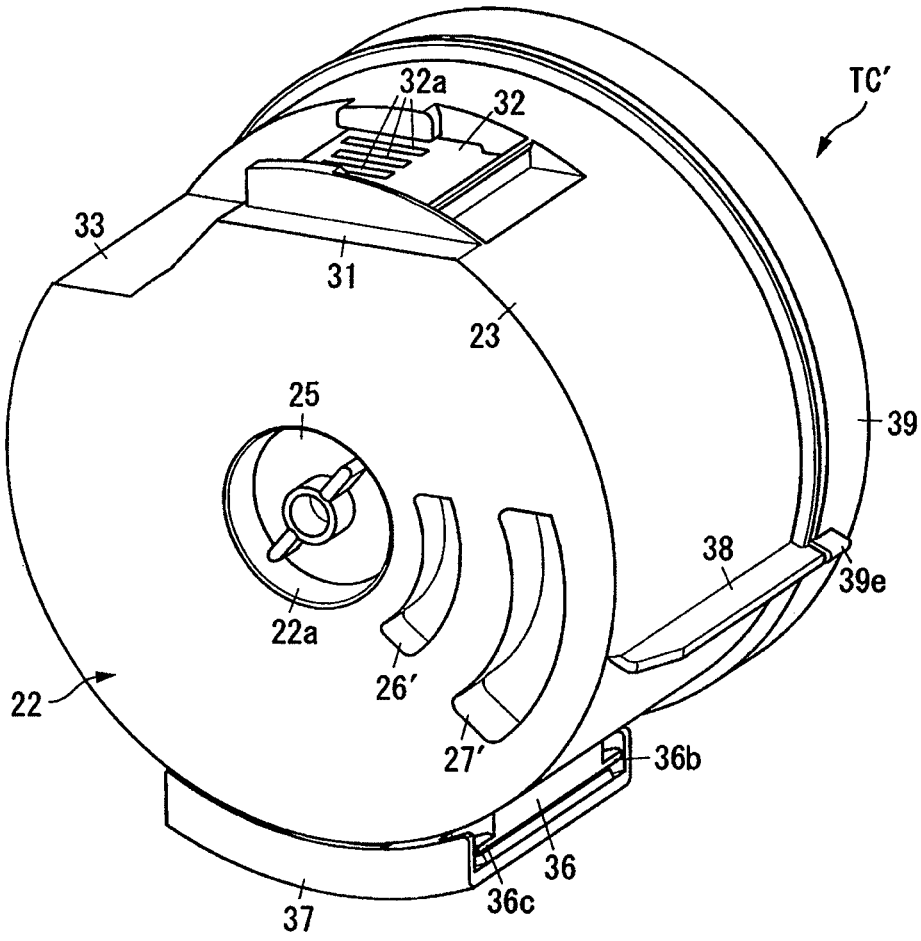
FIG. 16 is a schematic representation of a change example of exemplary embodiment 1 and is a drawing corresponding to FIG. 10 of exemplary embodiment 1.

FIG. 16 is a schematic representation of a change example of exemplary embodiment 1 and is a drawing corresponding to FIG. 10 of exemplary embodiment 1.

In FIG. 16, in the change example of exemplary embodiment 1, in a toner cartridge TC' corresponding to a printer of a different model from the printer U, as for the positioning grooves 26 and 27 of the toner cartridge TC of exemplary embodiment 1, positioning grooves 26' and 27' are formed at shift positions in the diametric direction of the disk-like rear end wall 22. As the positions of the positioning grooves 26' and 27' change, the positioning projections 6 and 7 are also formed at positions corresponding to the positioning grooves 26' and 27'.

In the toner cartridges TC and TC' of exemplary embodiment 1 and the change example of exemplary embodiment 1, for example, the toner cartridges TC and TC' may be shipped to different destinations of Europe, North America, Asia, etc., as well as Japan and a plurality of models in OEM (Original Equipment Manufacturing) may be shipped. That is, the specifications of the corresponding printer U may differ and a developer different in composition, manufacturing process, melting point, fluidity, etc., may be stored in the toner cartridge TC, TC' in response to the printer U. Therefore, the toner cartridge TC corresponding to one model may be incompatible with a different model of printer U. Therefore, the positioning grooves 26 and 27, 26' and 27' can be formed at different positions for each different type of toner cartridge TC, TC' and the type of toner cartridge TC, TC' can be identified. If the user attempts to place the toner cartridge TC' in an incompatible printer U, the positioning projections 6 and 7 are not fitted into the positioning grooves 26' and 27' and interfere with them and the toner cartridge TC, TC' is not inserted to the placement position and erroneous placement of a different toner cartridge can be prevented.

Exemplary Embodiment 2

Figure 17:
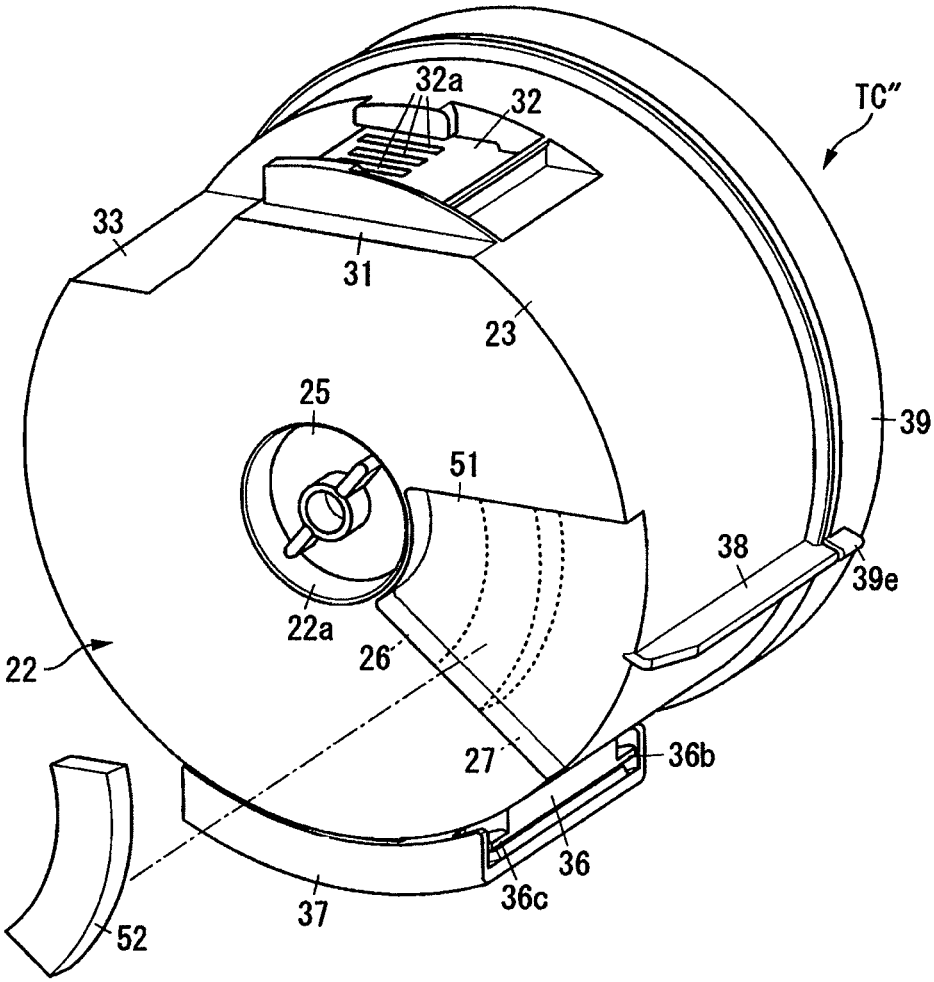
FIG. 17 is a schematic representation of a developer storage container of exemplary embodiment 2 and is a drawing corresponding to FIG. 10 of exemplary embodiment 1.

FIG. 17 is a schematic representation of a developer storage container of exemplary embodiment 2 and is a drawing corresponding to FIG. 10 of exemplary embodiment 1.

Exemplary embodiment 2 of the invention will be discussed. Components corresponding to those of exemplary embodiment 1 are denoted by the same reference numerals and will not be discussed again in detail.

Exemplary embodiment 2 differs from exemplary embodiment 1 only in the following:

In FIG. 17, in a toner cartridge TC" of exemplary embodiment 2, a sector-shaped common groove 51 corresponding to the connection shape of positioning grooves 26 and 27 as an example of a turn stop part is formed in place of the positioning grooves 26 and 27 of exemplary embodiment 1. A partition block 52 shaped like a circular arc formed as a different shape in response to the type of toner cartridge TC, the model of image forming apparatus, etc., as an example of a partition member can be placed in the common groove 51. Therefore, the partition block 52 corresponding to positioning projections 6 and 7 is placed, so that the positioning grooves 26 and 27 can be formed.

(Operation of Exemplary Embodiment 2)

In the toner cartridge TC of exemplary embodiment 2 including the configuration described above, the placed partition block 52 is replaced, whereby the toner cartridge becomes compatible with any model of image forming apparatus and any type of toner cartridge TC and a cartridge main body 21 is made common. Therefore, the manufacturing cost can be reduced as compared with the case where the toner cartridge TC is manufactured separately for each model and for each type.

Change Examples

While the exemplary embodiments of the invention have been described in detail, it is to be understood that the invention is not limited to the specific exemplary embodiments described above and various changes and modifications can be made without departing from the spirit and the scope of the invention as described in Claims. Change examples (H01) to (H010) of the invention are illustrated below:

(H01) In the exemplary embodiments described above, a printer is illustrated as an example of the image forming apparatus, but the image forming apparatus is not limited to the printer and, for example, can also be a copier, a facsimile machine, a multiple function device including some or all of the functions, or the like.

(H02) In the exemplary embodiments described above, as the printer U, the configuration wherein a single-color developer is used is illustrated, but the printer is not limited to it. For example, it can also be applied to an image forming apparatus of multiple colors of two or more colors. At this time, the diameter or the circular arc length of the positioning groove 26, 27 can be changed in response to the difference in the color of the developer stored in the toner cartridge TC, the type of toner such as the composition, melting point, fluidity of the developer, the destination of the toner cartridge, etc. The toner cartridge TC can be identified and can be prevented from being erroneously placed in an incompatible printer model or the cartridge storage section 3 not corresponding to the color of the toner cartridge.

(H03) In the exemplary embodiments described above, the rib 38 and the front rib 39*e* are provided, but they may be omitted. At this time, the inflow port shutter 14 can also be moved to the closing position using a spring as an example of an elastic member.

(H04) In the exemplary embodiments described above, the length, the width, etc., of the toner cartridge TC can be changed in response to the design, the specification, etc.

(H05) In the exemplary embodiments described above, the configuration of the agitator 41 is not limited to the configuration illustrated in the exemplary embodiments, and any already known configuration can be adopted.

(H06) In the exemplary embodiments described above, the upper end walls 26*b* and 27*b* are formed so as to be inclined downward as they are toward the rotation center, but they may also be formed so as to be inclined horizontally or upward.

(H07) In the exemplary embodiments described above, the number and the positions of the positioning projections 6 and 7 and the number and the positions of the positioning grooves 26 and 27 can be changed in response to the design, the specification, etc.

(H08) In the exemplary embodiments described above, as the CRUM 32 and the CRUM reader 9, the contact configuration wherein the connectors 9*a* and 32*a* are brought into contact with each other is illustrated, but the configuration is not limited to it and CRUM and CRUM reader of already known wireless communication type can also be adopted. The installing positions of the CRUM 32 and the CRUM reader 9 are not limited to the positions illustrated in the exemplary embodiment and can be changed in response to the design, etc.

(H09) In the exemplary embodiments described above, at the shipment time, the printer U, the toner cartridges TC, TC', and TC" can be packaged separately or they can be packaged in a state in which any of the toner cartridge TC, TC', or TC" is preinstalled in the printer U, and the number of package containers can also be decreased. If they are preinstalled, in a state in which the toner cartridge TC, TC', TC" moves to a detachable position, there is a possibility that the toner cartridge TC, TC', TC" may drop due to swing, etc., at the conveying time. Thus, to prevent the toner cartridge TC, TC', TC" from dropping off, the toner cartridge TC, TC', TC" may be a little rotated from a detachable position so that the toner cartridge TC, TC', TC" is caught in the cartridge storage section 3 to prevent dropping off. At this time, the toner cartridge TC, TC', TC" may be caught at a position shifting from the detachable position while the shutter 14 closing the inflow port 13*d* for preventing the developer from leaking, and while the shutter 37 closing the outflow port 36*a* for preventing the developer from leaking. As the direction in which the toner cartridge is a little rotated from the detachable position, the side of the undetachable position can also be adopted or the toner cartridge can also be rotated on the opposite side to the undetachable position not usually used.

As a method of catching the toner cartridge in the cartridge storage section 3, a projection can be provided or heat welding, press contact, or an adhesive can be used. The toner cartridge can be caught or can be brought into intimate contact or can be adhered only initially at preinstallation and when the worker rotates the toner cartridge from the preinstallation position, it peels off or is broken and can be placed so as not to be later caught. A part of the cartridge storage section 3 or the toner cartridge TC, TC', TC" can be elastically deformed and can be held at the preinstallation position by an elastic restoration force. That is, the toner cartridge TC, TC', TC" can also be moved among the detachable position, the undetachable position, and the initial hold position in a preinstallation state.

(H10) In the exemplary embodiments described above, the circular arc length and the position of the positioning groove 26, 27, 26', 27' shaped like a circular arc can be changed in response to the design, the specification, etc. To identify the toner cartridge TC, TC', TC" and prevent erroneous placement of the toner cartridge TC, TC', TC", the circular arc length, the position in the diametric position, the width of the groove in the diametric position, the depth of the groove, the number of grooves, etc., can also be changed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer storage container comprising:

a container main body in which a developer is stored, the container main body that is configured to be attached to and detached from an attachment section provided in an image forming apparatus main body and, the container main body that is configured to at least rotate in a state that the container main body is inserted into the attachment section, to a detachable position at which the container main body can be detached from the attachment section and an undetachable position at which the container main body cannot be detached from the attachment section; an outflow port that is formed in the container main body and from which the developer flows out;

an open/closed member that moves relatively to the outflow port based on a rotation of the container main body, the open/closed member that is supported so as to move to an opened position at which the outflow port is opened and a closed position at which the outflow port is closed, the open/closed member that moves to the closed position when the container main body moves to the detachable position, the open/closed member that moves to the opened position when the container main body moves to the undetachable position; and a turn stop part that is formed on a wall face of the container main body, the wall face being provided on a downstream side in a insertion direction in which the container main body is inserted into the attachment section, the turn stop part that is dented to an upstream side in the insertion direction and has a circular arc shape being concentric with a rotation direction of the container main body.

2. A developer storage container comprising:

a container main body in which a developer is stored, the container main body that is configured to be attached to and detached from an attachment section provided in an image forming apparatus main body and, the container main body that is configured to at least rotate in a state that the container main body is inserted into the attachment section, to a detachable position at which the container main body can be detached from the attachment section and an undetachable position at which the container main body cannot be detached from the attachment section; an outflow port that is formed in the container main body and from which the developer flows out;

an open/closed member that moves relatively to the outflow port based on a rotation of the container main body, the open/closed member that is supported so as to move to an opened position at which the outflow port is opened and a closed position at which the outflow port is closed, the open/closed member that moves to the closed position when the container main body moves to the detachable position, the open/closed member that moves to the opened position when the container main body moves to the undetachable position; and a turn stop part that is formed on a wall face of the container main body, the wall face being provided on a downstream side in a insertion direction in which the container main body is inserted into the attachment section, the turn stop part that is dented to an upstream side in the insertion direction and has a circular arc shape being concentric with a rotation direction of the container main body.

3. The developer storage container according to claim 1, wherein, when the container main body moves to the undetachable position and the open/closed member moves to the opened position, the turn stop part is positioned on a side relative to a rotation center of the container main body.

4. The developer storage container according to claim 1, wherein the turn stop part has an upper end face and a lower end face of the circular arc shape being concentric with the rotation direction of the container main body, and when the container main body moves to the undetachable position and the open/closed member moves to the opened position, the turn stop part is positioned on a side relative to a rotation center of the container main body and the upper end face is inclined downward in a gravity direction as it is toward the rotation center of the container main body.

5. The developer storage container according to claim 1, further comprising: an information storage member that comes in contact with a contact terminal provided in the image forming apparatus main body, wherein at least information is read from the information storage member, and when the container main body is rotated from the detachable position toward the undetachable position, the information storage member comes in contact with the contact terminal before the turn stop part comes in contact with the convex part.

6. The developer storage container according to claim 1, wherein the turn stop part is formed at a concentrically different position in response to the type of the developer storage container.

7. The developer storage container according to claim 1, wherein the container main body comprises: a cylindrical tubular part that has a tubular tube wall and a bottom wall supported on one end side of the tubular tube wall and a lid member that closes the other end side of the tubular tube wall of the cylindrical tubular part, and wherein the open/closed member and the information storage member are provided on the tubular tube wall and the turn stop part is provided on the bottom wall of the cylindrical tubular part.

8. The developer storage container according to claim 7, wherein when the container main body moves to the undetachable position, the outflow port is formed so as to be inclined downward in a gravity direction relative to a diametric direction of the tubular tube wall.

9. An image forming apparatus comprising: an image holding body; a developing device that develops a latent image formed on a surface of the image holding body to a visible image; and a developer storage container according to claim 1, that stores a developer to be supplied to the developing device.

10. The developer storage container according to claim 2, wherein, when the container main body moves to the undetachable position and the open/closed member moves to the opened position, the turn stop part is positioned on a side relative to a rotation center of the container main body.

11. The developer storage container according to claim 2, wherein the turn stop part has an upper end face and a lower end face of the circular arc shape being concentric with the rotation direction of the container main body, and when the container main body moves to the undetachable position and the open/closed member moves to the opened position, the turn stop part is positioned on a side relative to a rotation center of the container main body and the upper end face is inclined downward in a gravity direction as it is toward the rotation center of the container main body.

12. The developer storage container according to claim 2, further comprising: an information storage member that comes in contact with a contact terminal provided in the image forming apparatus main body, wherein at least information is read from the information storage member, and when the container main body is rotated from the detachable position toward the undetachable position, the information storage member comes in contact with the contact terminal before the turn stop part comes in contact with the convex part.

13. The developer storage container according to claim 2, wherein the turn stop part is formed at a concentrically different position in response to the type of the developer storage container.

14. The developer storage container according to claim 2, wherein the container main body comprises: a cylindrical tubular part that has a tubular tube wall and a bottom wall supported on one end side of the tubular tube wall and a lid member that closes the other end side of the tubular tube wall of the cylindrical tubular part, and wherein the open/closed member and the information storage member are provided on the tubular tube wall and the turn stop part is provided on the bottom wall of the cylindrical tubular part.

15. The developer storage container according to claim 14, wherein when the container main body moves to the undetachable position, the outflow port is formed so as to be inclined downward in a gravity direction relative to a diametric direction of the tubular tube wall.

16. An image forming apparatus comprising: an image holding body; a developing device that develops a latent image formed on a surface of the image holding body to a visible image; and a developer storage container according to claim 2, that stores a developer to be supplied to the developing device.

17. The image forming apparatus according to claim 9, wherein the turn stop part is configured to engage with a convex part in the image forming apparatus which (i) projects to the upstream side in the insertion direction and (ii) is provided in the attachment section, the turn stop part that has at least a central angle corresponding to a rotation angle at which the container main body rotates to the detachable position and the undetachable position, and the turn stop part that comes in contact with the convex part when the open/closed member moves to the opened position.

18. The developer storage container according to claim 1, wherein the turn stop part is configured to engage with a convex part in the image forming apparatus which (i) projects to the upstream side in the insertion direction and (ii) is provided in the attachment section, the turn stop part that has at least a central angle corresponding to a rotation angle at which the container main body rotates to the detachable position and the undetachable position, and the turn stop part that comes in contact with the convex part when the open/closed member moves to the opened position.

19. The image forming apparatus according to claim 16, the turn stop part is configured to engage with a convex part which (i) projects to the upstream side in the insertion direction, and (ii) is provided in the attachment section.

20. The developer storage container according to claim 2, wherein the turn stop part is configured to engage with a convex part which (i) projects to the upstream side in the insertion direction, and (ii) is provided in the attachment section.

* * * * *